US008867766B2

(12) United States Patent
Roeck

(10) Patent No.: US 8,867,766 B2
(45) Date of Patent: Oct. 21, 2014

(54) METHOD FOR PRODUCING A SIGNAL WHICH IS AUDIBLE BY AN INDIVIDUAL

(75) Inventor: Hans-Ueli Roeck, Hombrechtikon (CH)

(73) Assignee: Phonak AG, Staefa (CH)

( * ) Notice: Subject to any disclaimer, the term of this patent is extended or adjusted under 35 U.S.C. 154(b) by 1276 days.

(21) Appl. No.: 12/669,077

(22) PCT Filed: Jul. 17, 2007

(86) PCT No.: PCT/EP2007/057396

§ 371 (c)(1),
(2), (4) Date: Jan. 14, 2010

(87) PCT Pub. No.: WO2009/010095

PCT Pub. Date: Jan. 22, 2009

(65) Prior Publication Data

US 2010/0183172 A1 Jul. 22, 2010

(51) Int. Cl.
*H04R 25/00* (2006.01)

(52) U.S. Cl.
CPC ..... *H04R 25/453* (2013.01); *H04R 2460/11* (2013.01); *H04R 2225/43* (2013.01); *H04R 25/505* (2013.01)
USPC ..... 381/317; 381/312; 381/72

(58) Field of Classification Search
USPC ..... 381/71.2, 71.6, 71.5, 71.1, 72, 74, 317, 381/150, 312
See application file for complete search history.

(56) References Cited

U.S. PATENT DOCUMENTS

| | | | | |
|---|---|---|---|---|
| 7,079,645 | B1 * | 7/2006 | Short et al. | 379/388.03 |
| 7,365,669 | B1 * | 4/2008 | Melanson | 341/143 |
| 8,036,394 | B1 * | 10/2011 | Yonemoto et al. | 381/61 |
| 8,290,169 | B1 * | 10/2012 | Caesar | 381/61 |
| 2012/0170765 | A1 * | 7/2012 | Clemow | 381/71.6 |

FOREIGN PATENT DOCUMENTS

| | | | |
|---|---|---|---|
| DE | 19935919 | A1 | 2/2000 |
| EP | 1542500 | A2 | 6/2005 |
| WO | 9843567 | A1 | 10/1998 |

OTHER PUBLICATIONS

International Search Report for PCT/EP2007/057396 dated May 16, 2008.
Written Opinion for PCT/EP2007/057396 dated May 16, 2008.

* cited by examiner

*Primary Examiner* — Duc Nguyen
*Assistant Examiner* — George Monikang
(74) *Attorney, Agent, or Firm* — Pearne & Gordon LLP

(57) ABSTRACT

Audible signals ($m_2$) which are transmitted via an uncontrolled transmission path (11) to an individual's ear wearing the control signal processing path (1) of a hearing device are compensated by audible signals ($m_3$) which are produced by an additional controlled signal processing path (20). Signal processing parts are commonly exploited (25*b*, 25*d*, 7/27) by both controlled signal processing paths (1, 20).

18 Claims, 4 Drawing Sheets

METHOD FOR PRODUCING A SIGNAL WHICH IS AUDIBLE BY AN INDIVIDUAL

The present invention is directed to a method for producing a signal which is audible by an individual and which comprises processing acoustical signals along a controlled signal processing path to result in a first audible output signal as a first component of the audible signal to be produced.

Definition "Controlled Signal Processing Path"

We understand under a "controlled signal processing path"-addressed by CSPP—a signal path along which an input signal is processed in a predetermined and technically controllable manner.

The method further departs from acoustical signals being transmitted along an uncontrolled signal transmission path to result in a second audible signal as a second component of the audible signal to be produced.

Definition "Uncontrolled Signal Transmission Path"

We understand under an uncontrolled signal transmission path—addressed by UCSTP—a signal path along which an input signal is transmitted in a technically hardly influencable manner due to e.g. human interaction and/or natural dynamic variations.

Figure 1:
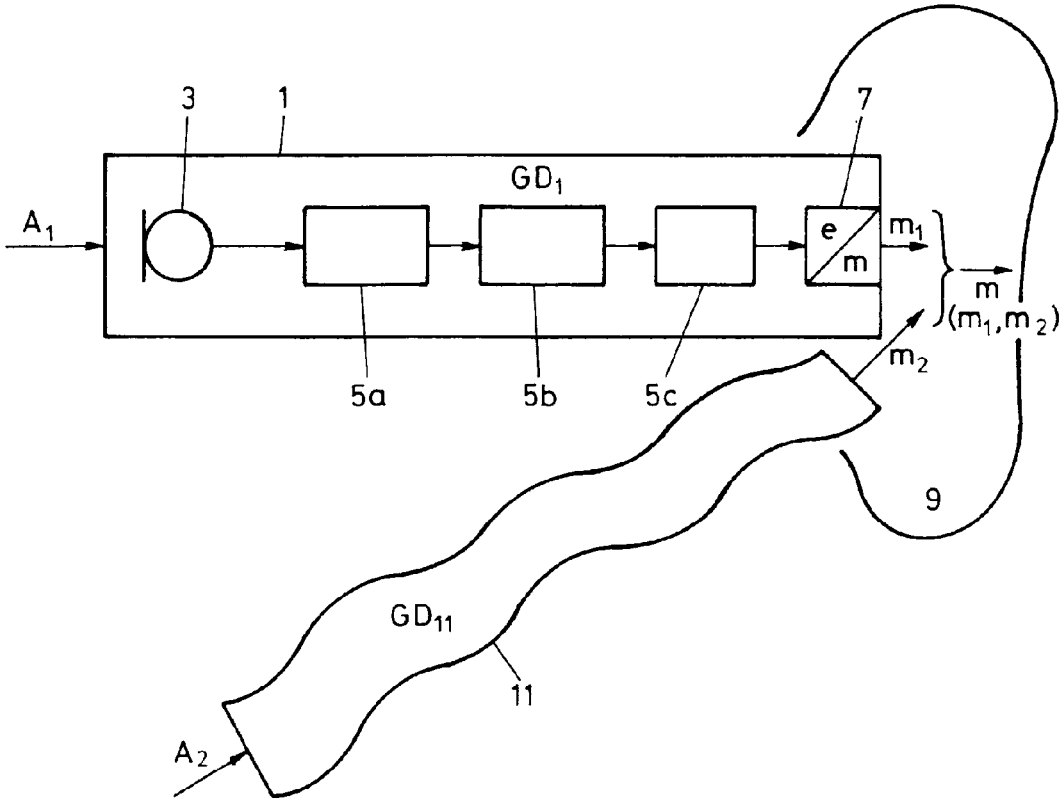

This method upon which the present invention resides shall be exemplified with the help of FIG. 1 which shows a generic and simplified signal-flow/functional-block diagram performing such addressed method.

Primarily, it must be pointed out that the method as addressed above and the respective acoustical situation arise whenever an individual wears a hearing device. Thereby, the CSPP is established by the input acoustical-to-electrical converter arrangement of the device and the subsequent signal processing up to and including output electrical-to-mechanical conversion at a respective output-converter arrangement of the device. The UCSTP on the other hand becomes established and is present due to all acoustical signal transmission bypassing and parallel to the CSPP to the individual acoustical perception. Thus, the UCSTP comprises bone acoustical transmission, acoustical transmission along and through the shell of the device, along spaces and gaps between the applied hearing device and the surface of the individual, through vents, etc. etc.

Definition "Hearing Device"

We understand under a hearing device a device which is worn adjacent to and/or in an individual's ear with the object to improve individual's acoustical perception. Such improvement may also be barring acoustical signals from being perceived in the sense of hearing protection for the individual.

If the hearing device is tailored so as to improve the perception of a hearing impaired individual towards hearing perception of a "normal" hearing individual, then such hearing device is called a hearing aid device.

With respect to the application area a hearing device may be applied behind the ear, in the ear, partly behind and partly in the ear, completely in the ear canal or may be at least in part implanted. A hearing device may further be applied to a single ear or to both ears up to being part of a system with binaurally applied hearing devices and intercommunication between these hearing devices.

According to FIG. 1 acoustical signals $A_1$ are processed along CSPP 1 to result in a mechanical output signal $m_1$.

The CSPP 1 comprises input acoustical to electrical converting by arrangement 3, processing by a series of signal processing units 5*a* to 5*c* and, at an output, electrical to mechanical converting at an arrangement 7. The output mechanical signal $m_1$ is audible and respectively applied to individual's ear 9.

As further shown in FIG. 1 there is present a UCSTP 11. Along this UCSTP 11 acoustical signals $A_2$ are transmitted and result in output signals $m_2$ which are too audible by the individual. The transmission along the addressed UCSTP 11 is uncontrolled as it varies with a huge number of parameters which are normally not known or not controllable and which may vary in an unknown or uncontrollable manner. Signal transmission along the processing units 3, 5*a*-5*c*, 7 in the CSPP 1 establishes a first group delay $GD_1$ which is significantly larger than the group delay $GD_1$ which is established by the transmission along the UCSTP 11. The group delay $GD_{11}$ caused by the transmission along the UCSTP 11 may be very close or identical to the group delay as encountered in direct transmission of acoustical signals through ambient air.

Definition "Group Delay"

We understand under "group delay" the delay between an input signal impinging on the input side of a signal transmission path up to occurrence of an output- or result signal of the transmission which is caused by the addressed input signal as defined by $$\tau(\omega) = -\frac{\partial}{\partial\omega}\{\arg[H(e^{j\omega})]\},$$

where $H(e^{j\omega})$ is the transfer function of the above transmission path.

The audible signals $m_1$ as resulting from processing along the CSPP 1 and $m_2$ as resulting from transmission along the UCSTP 11 become both effective as respective components of the audible signal m to the individual.

Superposition of the audible signal $m_2$ to the audible signal $m_1$ or in fact the presence of $m_2$ per se may result in considerable disturbances for the individual's perception. Thus, as a simple example, the acoustical signal $A_1$ is perceived by the individual via $m_1$ in an improved e.g. amplified manner due to operation of the CSPP 1. According to the difference of group delays $GD_1$ and $GD_{11}$, perception of $A_1$ is preceded, leading, assuming $A_1$ being similar to $A_2$, to a quite unnatural echoing effect, whereat the echo is louder than the preceding acoustical signal.

It is known that whenever a hearing device or a part of a hearing device is introduced into the ear canal of an individual, latter will feel a sensation of occlusion of the ear canal. This sensation becomes the more pronounced, the tighter that the addressed part is fitted to the ear canal. Thus, to prevent the addressed sensation of occlusion there exists the tendency in hearing device art to provide large vent systems along the periphery of that hearing device part which is introduced in the ear canal, larger than would be necessary just for venting the ear drum area. Thereby, on one hand, the sensation of occlusion is lowered, but, on the other hand, there is established less and less attenuation along the UCSTP 11 up to establishing practically direct acoustical ambient air transmission from individual's surrounding, bypassing processing along the CSPP 1 of the hearing device, finally to individual's ear drum area.

In such so called "open" fitted hearing devices, all kinds of noise signals are transmitted in a substantial manner through UCSTP 11 to the eardrum. Any noise canceling methods as applied in a hearing device—i.e. along CSPP 1—become therefore ineffective or at least loose their performance.

The present invention has the object to at least reduce the effect of uncontrolled transmission—UCSTP 11—of acoustical signals resulting in an audible signal component with respect to such audible signal generated as a result of signal processing along a controlled signal processing path—CSPP 1.

This object is achieved according to the present invention by processing acoustical signals along a second controlled signal processing path (CSPP) to result in a third audible signal which compensates at least in part the second audible signal. Processing along the second CSPP exploits a part of processing along the first CSPP which processing part includes electrical-to-mechanical output converting.

As was explained above the first CSPP1 provides for a first group delay $GD_1$. Signal transmission along the CSTP 11 provides for a second group delay $GD_{11}$. The second CSPP as inventively provided establishes for a third group delay—$GD_{20}$. One parameter which is substantially decisive for the degree of compensation of the output signal from the UCSTP 11 by the output signal of the inventively provided second CSPP is the difference of the group delays $GD_{20}$ and $GD_{11}$. In any case the group delay as established by the second CSPP is considerably shorter than group delay as established by the first CSPP. Accurate signal compensation is already achieved if there is valid:

$$\Delta=|GD_{20}-GD_{11}|\leq 40\ \mu\text{sec.}$$

Such signal compensation is further improved, if Δ becomes at most 20 μsec. or even at most 10 μsec.

Exploitation of a processing part of processing along the first CSPP 1 also for establishing processing along the second CSPP significantly lowers the overall system complexity and bulkiness, whereby the addressed selection still allows maintaining the group delay $GD_{20}$ in the order of $GD_{11}$ or even practically equal to $GD_{11}$.

By commonly exploiting single electrical-to-mechanical output converting for the processing along the first as well as along the second CSPP complexity and bulkiness of a system which performs the inventive method is significantly lowered. In fact, superposition of the audible output signal of both CSPP's is established electrically, at the latest just upstream the addressed electrical-to-mechanical output converting step.

In one embodiment of the method according to the present invention acoustical-to-electrical converting of the processing along the first CSPP is also exploited for processing along the second CSPP.

As mostly the acoustical signals which are converted and transmitted along the UCSTP result from the same acoustical sources as the acoustical signals which are processed along the first CSPP, one common input acoustical-to-mechanical converting step is exploited as a processing part of processing along the first as well as as a processing part of processing along the second CSPP.

Most of today's hearing devices which provide for processing along the first CSPP, perform such processing digitally. To do so, downstream acoustical-to-electrical converting there is performed analog-to-digital converting, ADC. Downstream the ADC the digital signals are further processed, along the first CSPP, by digital signal processing including programmable signal processing, be it in time- or be it in frequency-domain.

Definition "Digital Signal Processing", "Programmable Digital Signal Processing"

When we speak of "digital signal processing" we address such processing most generically. When we speak on the other hand of "programmable digital signal processing" we address digital signal processing which is performed under program control as customarily performed in a DSP unit.

Thus, not variable digital filtering or digital-to-analog converting or time domain/frequency domain converting and respectively, frequency domain/time domain converting are addressed as "digital signal processing". In opposition thereto processing digital signals by means of a processor which is controlled by a series of instructions and/or parameters, at least a part thereof being externally variable, is addressed as "programmable digital signal processing" as a specific processing of the "digital signal processing" type.

Downstream programmable digital signal processing as addressed above the digital signals are converted to bring them in proper form so as to be subjected to output electrical-to-mechanical converting, i.e. they are digital-to-analog converted.

Along such processing chain including the addressed programmable digital signal processing as normally performed at one or more than one DSP's, the addressed ADC or at least a part of such ADC provides only for a small group delay compared with the group delay as provided by the downstream digital signal processing including the programmable digital signal processing. Therefore and in a further embodiment of the invention processing along the second CSPP exploits analog-to-digital converting of the processing along the first CSPP.

Very often analog-to-digital converting is performed in hearing devices by sigma-delta converting, which is performed at a high sampling rate and results in a high rate one-bit or multi-bit data stream. After anti-aliasing filtering as perfectly known to the skilled artisan, the signal is downsampled, resulting in data samples of a desired number of digits at a significantly lower sampling rate. This anti-aliasing filtering and downsampling may also occur in multiple stages.

In a further embodiment the ADC which is commonly exploited thus comprises sigma-delta converting.

In a further embodiment wherein the processing along the first CSPP comprises signal processing at different sampling rates and wherein signal processing along the second CSPP has a bypassing processing part, which bypasses a part of the processing along the first CSPP, the addressed bypassing processing part performs signal processing at one single sample rate. One example of such a first CSPP includes sigma-delta converting as was addressed above. By the latter embodiment up- or downsampling is avoided along the bypassing processing part of the second CSPP.

In a further embodiment processing along the second CSPP exploits a processing part of processing along the first CSPP which includes at least a part of digital-to-analog signal converting.

In a further embodiment processing along the first CSPP comprises programmable digital signal processing, whereby processing along the second CSPP bypasses such programmable digital signal processing as performed along the first CSPP.

In a further embodiment the processing along the first CSPP comprises time-domain to frequency-domain converting as well as frequency-domain to time-domain converting. The processing along the second CSPP thereby bypasses such domain convertings.

In a further embodiment processing along the second CSPP includes signal filtering within a processing part which bypasses processing along the first CSPP. By means of such filtering, and as an example, controlled phase and magnitude adaptation to the signal output from the addressed uncontrolled signal transmission path (UCSTP) may be achieved so as to optimize compensating thereof.

In a further embodiment processing along the first CSPP comprises programmable signal processing which controls the addressed filtering along the second CSPP.

In a further embodiment the addressed bypassing part of the second CSPP comprises low-pass noise filtering.

In a further embodiment, wherein processing along the first CSPP comprises analog-to-digital as well as digital-to-analog converting, a part of the analog-to-digital converting process as well as a part of the digital-to-analog converting process is exploited for the processing along the second CSPP, whereby another respective part of the addressed convertings is bypassed by the processing along the second CSPP.

As an example when sigma-delta ADC and DAC is applied along the first CSPP, anti-aliasing filtering and downsampling at the ADC as well as upsampling and anti-imaging filtering at the DAC are advantageously bypassed by signal processing along the second CSPP.

Thus, in a further embodiment processing along the first CSPP comprises anti-aliasing filtering and anti-imaging filtering, both these filterings being bypassed by signal processing along the second CSPP.

As was addressed above, one parameter which is substantially decisive for the result achieved when compensating the audible output signal of the UCSTP is the difference of group delays of the second CSPP and the addressed USCTP. Measuring such group delay differences is not always easy.

For most common group delays of USCTP good compensating results will be achieved if the group delay along the second CSPP, $GD_{20}$, is at most 200 μsec. or at most 100 μsec. or at most 30 μsec.

The invention shall now be further described by means of examples and with the help of further figures.

Figure 2:
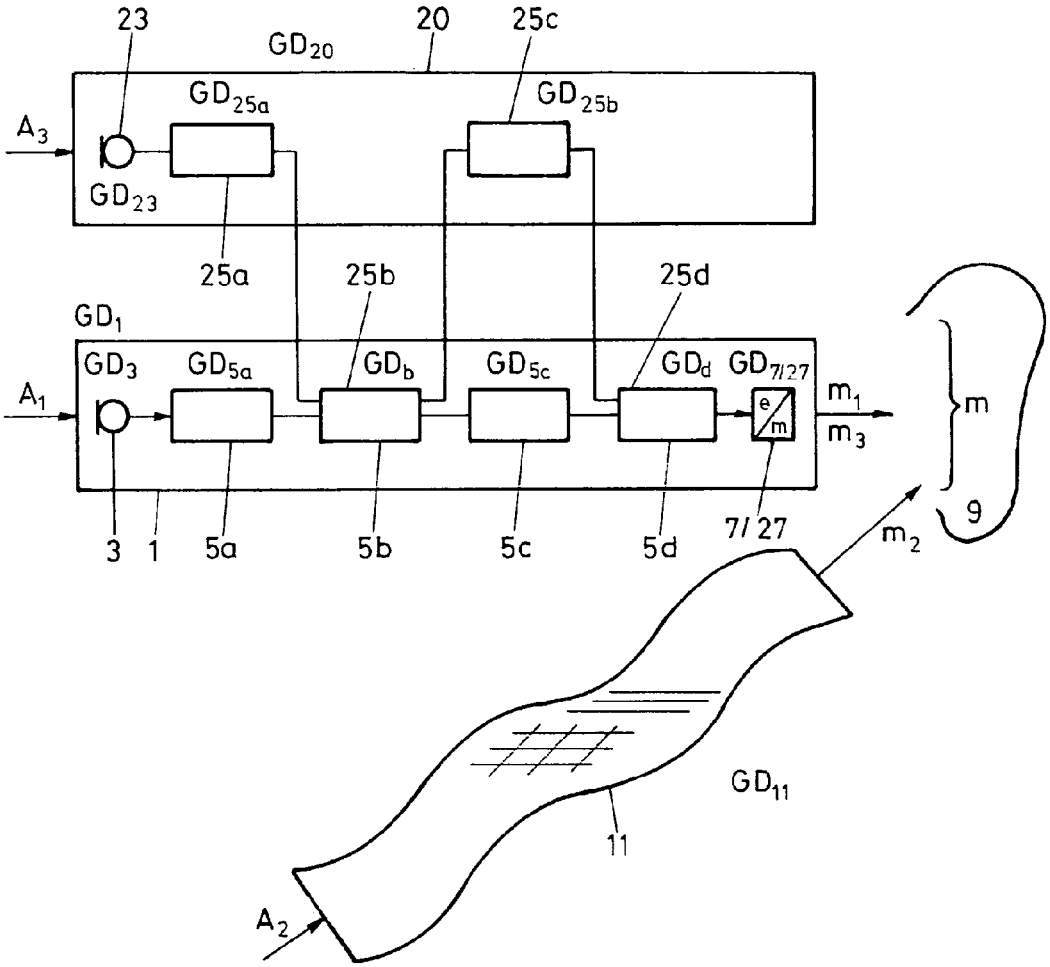
Figure 3:
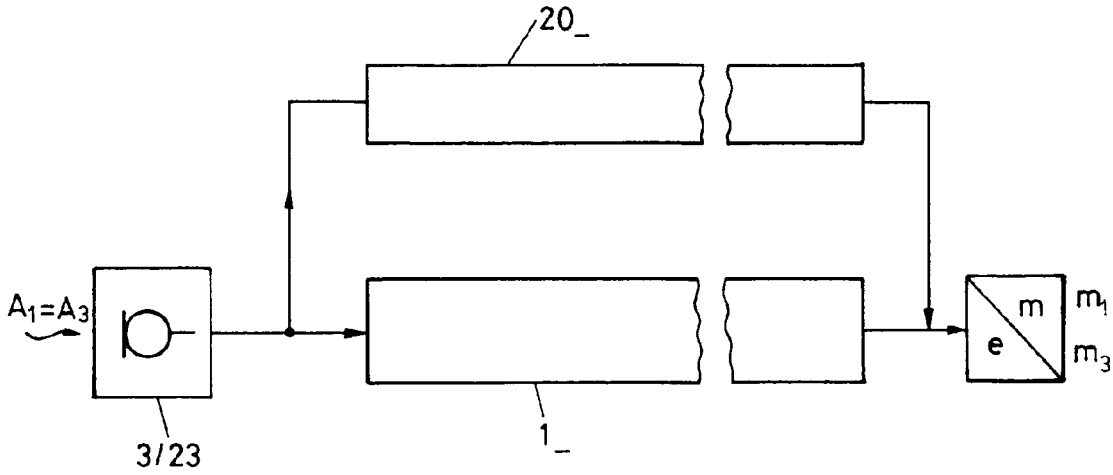
Figure 4:
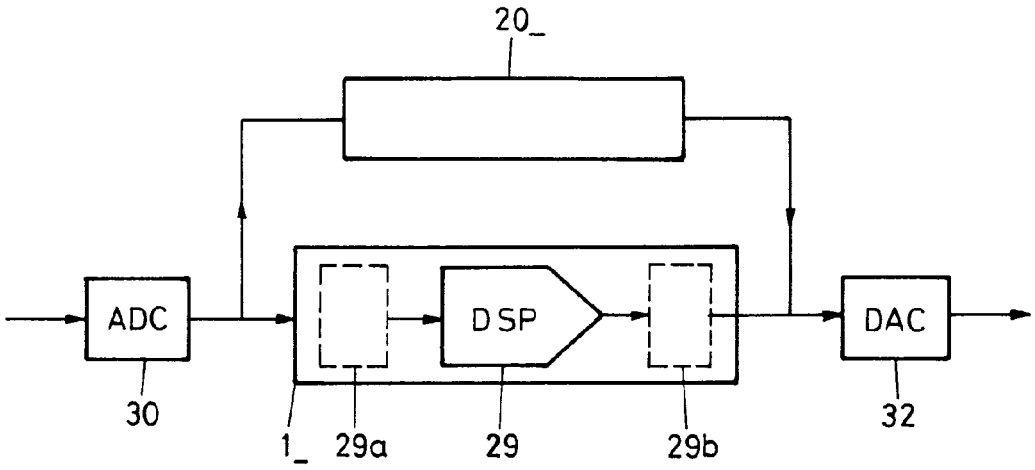
Figure 5:
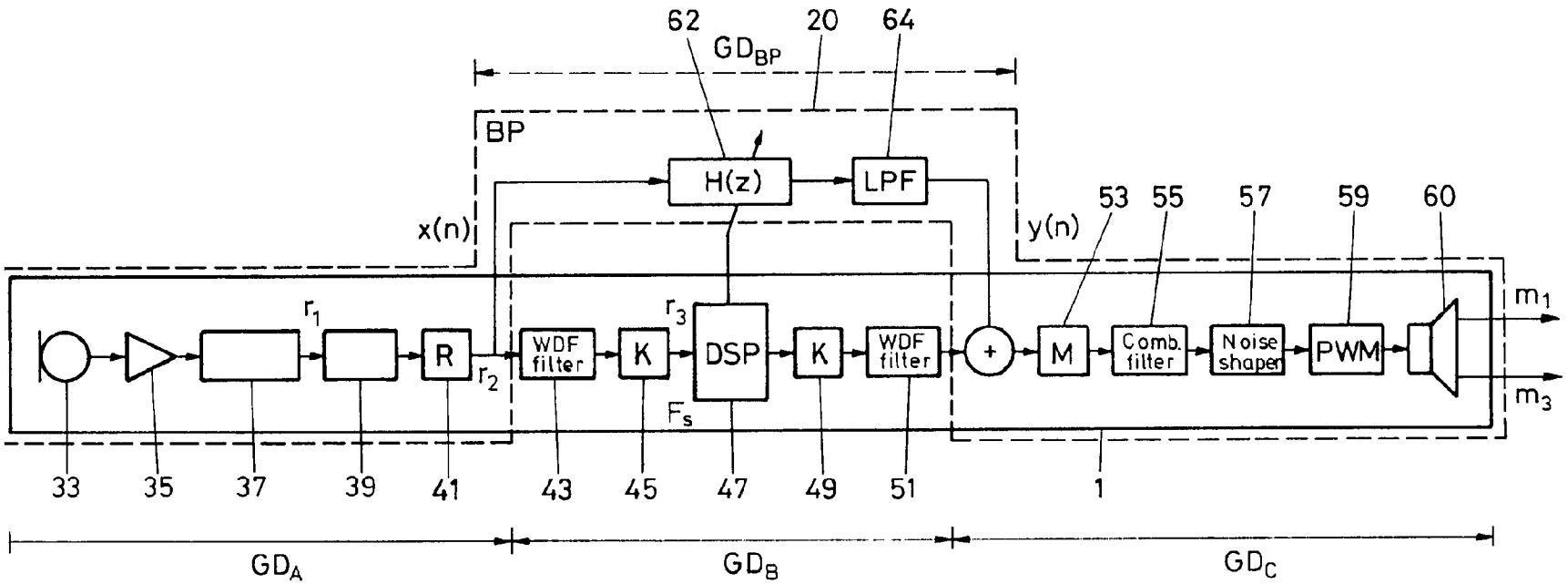

The figures show:

FIG. 1 shows a generic and simplified signal-flow/functional-block diagram of audible signals;

FIG. 2 in a schematic and simplified representation in analogy to that of FIG. 1, a first embodiment of performing the method according to the present invention;

FIG. 3 in a simplified signal-flow/functional-block diagram, a further embodiment of performing the method according to the present invention;

FIG. 4 still in a simplified signal-flow/functional-block diagram, still a further embodiment of performing the method according to the present invention, and FIG. 5 in a simplified, more detailed signal-flow/functional-block diagram, an embodiment of performing the method according to the present invention, thereby exploiting signal processing as common to a customary digital hearing device.

FIG. 2 departs from the representation according to FIG. 1, in which the generic problem to be addressed by the present invention has been described.

Accordingly, FIG. 2 shows in most generic terms an embodiment according to the present invention. There is performed processing along a second CSPP 20. Acoustical signals $A_3$ are processed along this second CSPP 20 by input acoustical-to-electrical converting at an arrangement 23 and subsequent processing steps at units 25*a* to 25*d* up to and including output electrical-to-mechanical converting at an arrangement 7. Thereby, signal processing along second CSPP 20 exploits, as a processing part, processing parts and thus respective processing units, which are part of the processing along the first CSPP 1. Thus and according to FIG. 2 the second processing step and, respectively, the second processing unit 25*b* of processing along the second CSPP 20 is performed or respectively realized by processing step 5*b* and a respective unit 5*b* of processing along the first CSPP 1. The same is valid for steps and units 25*d* and 27 of processing along the second CSPP 20 and steps or units 5*d* and 7 of processing along the first CSPP 1. Signal processing along the second CSPP 20 is performed so that the output signal $m_3$ which is audible by the individual at least in part compensates the audible signal $m_2$ which is transmitted along the UCSTP 11.

As further shown in FIG. 2 each of the processing steps performed by the respective units in both for the processings along the first and along the second CSPP 1, 20 contributes with a respective group delays GD to the total group delay $GD_1$, $GD_{20}$ of the processing along the respective CSPP's. As was addressed above the group delay $GD_{11}$ of the UCSTP 11 is substantially shorter than the group delay $GD_1$ along the first CSPP 1 which consists of the sum of the group delays $GD_3$, $GD_{5a}$, $GD_b$, $GD_{5c}$, $GD_d$, $GD_{7/27}$.

The overall group delay $GD_{20}$ of the second CSPP 20 consists of the sum of $GD_{23}$, $GD_{25a}$, $GD_b$, $GD_{25b}$, $GD_d$ and $GD_{7/27}$. The selection which of the processing steps along the first CSPP 1 are also to be processing part of processing along the second CSPP 20 is made, so that the overall group delay $GD_{20}$ is at most 200 μsec. or at most 100 μsec. or at most 30 μsec., this especially in dependency of the prevailing group delay $GD_{11}$ of the USCTP 11. In any case the overall group delay $GD_{20}$ is substantially shorter than the group delay $GD_1$ and the difference A between $GD_{20}$ and $GD_{11}$ should not exceed 40 μsec. Even more accurate compensation of $m_2$ by $m_3$ is achieved if Δ is at most 20 μsec. or even at most 10 μsec.

Clearly ideally the group delay $GD_{20}$ is tailored to be equal to the group delay $GD_{11}$ which may be difficult to realize and to maintain, when considering time variations of $GD_{11}$. Nevertheless, by realizing the group delay difference A as addressed above or, in other words, a group delay $GD_{20}$ which is in the same order of extent as $GD_{22}$, compensation of $m_2$ becomes possible to such an extent that the disturbances as addressed above are practically not perceived by the individual.

Thus with the help of FIG. 2 the generic solution according to the present invention has been exemplified.

With an eye on FIG. 2 it becomes apparent that in most cases the acoustical signals $A_2$ transmitted via UCSTP 11 and $A_1$ processed along CSPP 1 may be considered to come from same acoustical sources. Thus, to perform the addressed compensation by processing along the second CSPP 20, an acoustical-to-electrical input conversion may be exploited, which is also exploited for processing along CSPP 1.

This results in signal processing as schematically shown in FIG. 3, wherein 20_ and 1_ respectively stand for the first and, respectively, second CSPP of FIG. 2 minus the commonly exploited acoustical-to-electrical converting step 3/23 and electrical-to-mechanical converting step 7/27.

In FIG. 4 there is schematically shown a further embodiment of the present invention. If signal processing along both, the first and second CSPP 1 and 20, is to be done by digital signal processing, then at least a part of analog-to-digital converting and/or of digital-to-analog converting may be performed commonly for both of the addressed CSPP. In FIG. 4 there is shown commonly exploiting analog-to-digital converting at an ADC converting unit 30 in combination with commonly exploiting digital-to-analog converting at a DAC unit 32. Thereby, the second CSPP 20 as of FIG. 2 bypasses especially programmable digital signal processing at a DSP unit 29 along the first CSPP 1 and, if provided, time-domain to frequency-domain converting at unit 29*a* as well as frequency-domain to time-domain converting at unit 29*b*.

Please note that we use reference numbers 1_ and 20_ with an eye on the generic representations of FIGS. 1 and 2 whenever the addressed processings are only parts of the processings along CSPP 1 or CSPP 20.

Still with an eye on FIG. 4 programmable digital signal processing in DSP 29 contributes a relatively long group delay. By bypassing especially such processing step by processing along the second CSPP 20 the group delay along the addressed second CSPP 20 becomes significantly shorter than the group delay along the first CSPP 1 and may be tailored to fulfill the conditions as addressed above.

Whenever further processings with significantly long group delays are exploited by processing along the first CSPP 1 as e.g. time domain to frequency domain converting and frequency domain to time domain converting, such processing steps are bypassed by the signal processing along the second CSPP 20.

The second CSPP20 may also comprise programmable digital signal processing as long as such processing does not spoil the $GD_{20}$ to be achieved.

In FIG. 5 there is shown in more details but still simplified, by means of a signal-flow/functional-block diagram, a further embodiment according to the present invention. In FIG. 5 the signal-flow/functional-block diagram of a hearing device of customary type is shown at which, to perform the method according to the present invention, additional processing steps are applied via a second CSPP 20 as was described. The customary hearing device resides as an example in a shell (not shown) with vents which are significantly larger in cross-section than just necessary for venting the ear drum of the individual. Thereby, on one hand the sensation of occlusion by the individual is reduced, but, on the other hand, such enlarged vent system significantly contributes to acoustical signal transmission according to a UCSTP 11 as of the FIG. 1 or 2.

Signal processing of the addressed conventional hearing device establishes for the first CSPP 1 as was discussed generically in context with FIG. 1 or 2. It comprises input acoustical-to-electrical converting by a respective arrangement 33, the result signal being operationally subjected to pre-amplifying, 35, the result signal of which being operationally subjected to sigma-delta ADC converting 37. Sigma-delta converting 37 results in a one-bit or multi-bit output data stream. Conversion is performed at a high sampling rate $r_1$. The result signal of the ADC, 37, is operationally subjected to a first anti-aliasing filtering, 39, the result signal thereof is downsampled by a factor R to a sampling rate $r_2$, 41, leading to data samples of a desired number of digits. Thereby, the sampling rate $r_2$ is significantly lower than the sampling rate $r_1$. The data samples resulting from first downsampling are further subjected to a $2^{nd}$ anti-aliasing filtering, 43, e.g. in wave-digital filtering (WDF) form, further to a $2^{nd}$ downsampling by a factor K to a $3^{rd}$ sample rate $r_3$ and then processed by programmed digital signal processing, 47. The result signal thereof is subjected to upsampling by a factor K, then to e.g. WDF based anti-imaging filtering 51. The resulting signal is then further upsampled by a factor M, 53, and treated by comb filtering for additional anti-imaging filtering, 55, by noise shaping, 57, and by converting to a pulse width modulated (PWM) signal, 59. The PWM signals is subjected to electrical-to-mechanical converting, 60, e.g. by a speaker arrangement.

As an example the sampling rate $r_1$ of the sigma-delta conversion is usually 500 kHz to 2 MHz. Downsampling leads to a sampling rate $r_2$ of e.g. 50-200 kHz. Up to the result of downsampling 41, according to FIG. 5, the group delay shown at $GD_A$ is small, e.g. in the order of 10-20 μsec. In opposition thereto processing 43 to 51 provides for a much larger group delay $GD_B$ due to complex programmed signal processing 47 in the DSP, but additionally due to WDF filterings 43, 51. There results a group delay $GD_B$ in the order of several 100 μsec. up to ca. 10 ms. At the end of the first CSPP 1, signal processings 53 to 60 exhibit again only a short group delay $GD_C$ in the range of $GD_A$. Signal processing as described to now is conventional and known to the skilled artisan.

According to the method of the present invention there is established processing along the second CSPP 20 as shown in dashed lines in FIG. 5. Thereby, the processing steps which are performed in the first CSPP 1 providing for short group delays $GD_A$ and $GD_C$, are exploited for processing along CSPP 20 too. CSPP 20 bypasses all the signal processing steps of the first CSPP 1 which exhibit large group delays as of $GD_B$.

Let us assume an in-the-ear hearing device with a length extent of 1.5 cm. Such hearing device shall have a wide open venting system to minimize occlusion sensation by the individual wearing such device. Thus, we assume practically direct transmission of acoustical signals between the location of the input acoustical-to-electrical converter arrangement of the device and the output electrical-to-mechanical converter arrangement of the addressed device. At a length extent of 1.5 cm and assumed direct acoustical transmission through and along the venting system, an acoustical signal will be delayed at the locus of the output converter by approx. 40 μsec. with respect to arrival at the locus of the input converter. This assuming a velocity of sound of 330 m/sec. Thereby, if $GD_A$ as well as $GD_C$ each are tailored in the range of 10 μsec., this leaves for processing along the bypassing part of second CSPP 20 addressed in FIG. 5 by BP a group delay $GD_{BP}$ to be targeted at of approx. 20 μsec. This so as to achieve, with respective signal amplification, ideal compensation of $m_2$ according to FIG. 1 or 2. Therefrom it might be seen that the addressed inventive method allows to highly accurately compensate for the addressed result signal $m_2$ of uncontrolled acoustical signal transmission, keeping in mind that a delay difference between $m_2$ and $m_3$ of FIG. 2 of few μsec. will not be perceived by the individual.

Turning back to the specific embodiment as of FIG. 5 there is provided, in the bypassing part BP of the second CSPP 20, signal filtering as by filter unit 62, whereby, under a first approximation, such filter unit may act e.g. as an all-pass filter, whereat phasing is shifted so as to achieve optimum compensation. The bypassing processing steps treat, according to FIG. 5, the downsampled signals by means of filtering at unit 62 which is preferably controlled by the programmable digital signal processing 47 at DSP so as to take into account different and varying transmissions of the UCSTP. The controlling of filter 62 may be with fast time constants in the few ms range for compensation of e.g. chewing effects on UCSTP 11 or of very long term with time constants e.g. in the several hours range or more for compensation of e.g. dirt in the vent etc. or somewhere in between. Filter 62 may also be fixed. The resulting signal of the bypassing processing of the second CSPP 20 is reapplied to the first CSPP 1 there where signal processing along that first CSPP is performed at the same rate as there where the input signal to the bypassing processing BP of the second CSPP 20 is tapped off. Thus, ideally no additional processing rate adaptation must be performed along the addressed bypassing processing BP to achieve compatibility of rates there where the output signal of the bypassing processing BP is superimposed to the signal along the first CSPP 1.

Further, there may be further applied to the result signal of controlled filtering 62 stationary low pass noise filtering 64 still in the bypassing processing part BP of the processing along the second CSPP 20 to get rid of remaining quantization noise of the sigma-delta conversion.

By the present invention there is established a highly effective method for cancelling or compensating the result of acoustical signals which bypass a hearing device, be it through a vent system, be it by bone or more generically body transmission, thereby exploiting signal processing steps which are already performed in the hearing device. The added processing necessitates additional signal processing only to a very restricted extent, namely only along that part of an established additional CSPP which bypasses slow processing steps along the hearing device signal processing path, especially the last anti-aliasing filter stage 43 in the ADC and the first anti-imaging filter 51 in the DAC besides of DSP.

What is claimed is:

1. A method for producing a signal which is audible by an individual, comprising processing acoustical signals along a first controlled signal processing path resulting in a first audible output signal as a first component of said audible signal, an uncontrolled transmission of acoustical signals along an uncontrolled signal transmission path being established to result in a second audible signal as a second component of said audible signal, reducing audibility of said second component by further processing acoustical signals as transmitted by said uncontrolled signal transmission path along a second controlled signal processing path to result in a third audible signal and compensating at least in part said second audible signal by said third audible signal;

exploiting for said processing along said second controlled signal processing path a processing part of processing along said first controlled signal processing path including electrical-to-mechanical output converting, wherein said processing along said first controlled signal processing path comprises signal processing at different sampling rates and wherein said processing along said second controlled signal processing path comprises a bypassing processing part, bypassing a part of said processing along said first signal processing path, whereal long signal processing is performed at one single sample rate.

2. The method of claim 1, wherein there is valid $$\Delta=|GD_{20}-GD_{11}|\leq 40\ \mu\text{sec.},$$

wherein there stands for:

$GD_{20}$: the group delay along said second controlled signal processing path $GD_{11}$: the group delay along said uncontrolled signal transmission path.

3. The method of claim 1, further comprising exploiting for processing along said second controlled signal processing path a processing part along said first controlled signal processing path which includes acoustical-to-electrical converting.

4. The method of claim 1, further comprising exploiting for processing along said second controlled signal processing path a processing part along said first controlled signal processing path which includes at least a part of analog-to-digital converting.

5. The method of claim 4, comprising performing said analog-to-digital converting as sigma-delta converting.

6. The method of claim 1, further comprising exploiting for processing along said second controlled signal processing path a processing part of said processing along said first signal processing path which includes at least a part of digital-to-analog signal converting.

7. The method of claim 1, said processing along said first controlled signal processing path comprising programmable digital signal processing, thereby bypassing by said processing along said second controlled signal processing path said programmable digital signal processing.

8. The method of claim 1, said processing along said first controlled signal processing path comprising time-domain to frequency-domain converting as well as frequency-domain to time-domain converting and said processing along said second controlled signal processing path bypassing said domain convertings.

9. The method of claim 1, said processing along said second controlled signal processing path comprising a bypassing processing part bypassing a processing part of said processing along said first controlled signal processing path, said bypassing processing part comprising filtering.

10. The method of claim 1, wherein said bypassing processing part comprises filtering, and wherein said bypassing processing part bypasses programmable digital signal processing of said processing along said first controlled signal processing path, said programmable processing controlling said filtering.

11. The method of claim 10, said bypassing processing part further comprising low pass noise filtering.

12. The method of claim 1, wherein said processing along said first controlled signal processing path comprises analog-to-digital and digital-to-analog converting and wherein respectively a part of said analog-to-digital converting and a part of said digital-to-analog converting is exploited for said processing along said second controlled signal processing path and an other part of said convertings, respectively, is bypassed by said processing along said second controlled signal processing path.

13. The method of claim 1, wherein said processing along said first controlled signal processing path includes anti-aliasing filtering and anti-imaging filtering, both being bypassed by processing along said second controlled signal processing path.

14. The method of claim 1, processing along said second controlled signal processing path providing for a group delay of at most 200 μsec.

15. The method of claim 14, wherein said group delay is at most 100 μsec.

16. The method of claim 14, wherein said group delay is at most 30 μsec.

17. The method of claim 2, wherein $\Delta=|GD_{20}-GD_{11}|\leq 20$ μsec.

18. The method of claim 2, wherein $\Delta=|GD_{20}-GD_{11}|\leq 10$ μsec.

* * * * *

UNITED STATES PATENT AND TRADEMARK OFFICE

CERTIFICATE OF CORRECTION

PATENT NO. : 8,867,766 B2
APPLICATION NO. : 12/669077
DATED : October 21, 2014
INVENTOR(S) : Hans-Ueli Roeck It is certified that error appears in the above-identified patent and that said Letters Patent is hereby corrected as shown below:

In the Specification,

Column 2, line 10; Please delete "$GD_1$" and add -- $GD_{11}$ --

Column 6, line 28; Please delete "A" and add -- Δ --

Column 6, line 34; Please delete "A" and add -- Δ --

Column 6, line 36; Please delete "$GD_{22}$," and add -- $GD_{11}$ --

Signed and Sealed this
Twelfth Day of May, 2015

Michelle K. Lee

Michelle K. Lee
*Director of the United States Patent and Trademark Office*